US010378868B2

(12) United States Patent
Siggers

(10) Patent No.: US 10,378,868 B2
(45) Date of Patent: Aug. 13, 2019

(54) EXPLOSIVE ORDNANCE COLD ASSEMBLY PROCESS

(71) Applicant: SPECTRA TECHNOLOGIES LLC, East Camden, AR (US)

(72) Inventor: David L. Siggers, Hot Springs, AR (US)

(73) Assignee: SPECTRA TECHNOLOGIES LLC, Camden, AR (US)

( * ) Notice: Subject to any disclaimer, the term of this patent is extended or adjusted under 35 U.S.C. 154(b) by 0 days.

(21) Appl. No.: 16/164,698

(22) Filed: Oct. 18, 2018

(65) Prior Publication Data

US 2019/0128654 A1 May 2, 2019

Related U.S. Application Data

(60) Provisional application No. 62/577,533, filed on Oct. 26, 2017.

(51) Int. Cl.
*F42B 33/02* (2006.01)

(52) U.S. Cl.
CPC ..... *F42B 33/0207* (2013.01)

(58) Field of Classification Search
CPC ..... F42B 33/0207
See application file for complete search history.

(56) References Cited

U.S. PATENT DOCUMENTS 4,459,914 A * 7/1984 Caruso ..... F42B 3/16 102/204
4,616,569 A * 10/1986 Montier ..... F42B 12/06 102/501
5,115,707 A * 5/1992 Kutzli ..... F42B 30/08 86/20.1
6,324,985 B1 * 12/2001 Petrusha ..... F42B 12/74 102/514

(Continued)

FOREIGN PATENT DOCUMENTS

KR 10-1656737 9/2016

OTHER PUBLICATIONS

Gander, Terry J, "More Bang for your Buck—Warhead Technology", EBSCO Publishing, p. 78, (Year: 2003).*

(Continued)

*Primary Examiner* — Joshua T Semick
(74) *Attorney, Agent, or Firm* — Greenberg Traurig, LLP

(57) ABSTRACT

An assembly process is described for producing an ordnance projectile wherein the projectile maintains a compressive force on an explosive body carried therein throughout an anticipated operational temperature range. The process includes raising the temperature of the hollow projectile body to an elevated temperature, cooling the explosive body to a temperature below a lowest anticipated operating temperature of the projectile, nesting the cooled explosive body within the hollow projectile body while the projectile is at the elevated temperature, securing the explosive body and the hollow projectile body together, and normalizing the (Continued)

temperature of the nested bodies by allowing them to come to a common temperature, typically room temperature. Different thermal expansion characteristics of the inner and outer bodies will result in the projectile maintaining a compressive force on the explosive body at normal temperatures.

20 Claims, 8 Drawing Sheets

(56) References Cited

U.S. PATENT DOCUMENTS

| | | | | |
|---|---|---|---|---|
| 6,655,295 | B2 * | 12/2003 | Baumgartner | F42B 12/34 102/510 |
| 6,883,435 | B1 * | 4/2005 | Schildknecht | F42B 12/08 102/473 |
| 7,661,368 | B2 * | 2/2010 | Riess | F42B 12/38 102/513 |
| 7,765,934 | B2 * | 8/2010 | Spatz | F42B 12/34 102/507 |
| 8,904,934 | B1 * | 12/2014 | Scheid | F42B 3/087 102/307 |
| 9,557,149 | B2 * | 1/2017 | Smylie | A62D 3/02 |
| 9,778,008 | B2 * | 10/2017 | Scheid | F42D 1/043 |
| 2004/0031380 | A1 | 2/2004 | Altenau | |
| 2004/0158969 | A1 * | 8/2004 | Ortmann | F42B 12/06 29/592 |
| 2011/0048270 | A1 | 3/2011 | Gustavsson | |
| 2011/0100245 | A1 | 5/2011 | Williams et al. | |
| 2014/0026780 | A1 | 1/2014 | Nechitailo | |

OTHER PUBLICATIONS

"A что это там RUAG замутила за 152-MM кумулятивныи заряд ?", http://www.vif2ne.org/forum/0/arhprint/1028580, p. 7, (Year : 2004).*

International Search Report and Written Opinion, dated Feb. 7, 2019, from corresponding International Patent App. No. PCT/US2018/056583.

* cited by examiner

| Input Parameters | Value | Unit of Measure |
|---|---|---|
| **Assembly Service Conditions** | | |
| Maximum Service and Storage Temperature ($T_{max.}$) | 160 | °F |
| Ambient Service and Storage Temperature ($T_{amb.}$) | 72 | °F |
| Minimum Service and Storage Temperature ($T_{min.}$) | -60 | °F |
| **Outer Body (Warhead Casing)** | | |
| Material Specification | AISI 4340 Normalized | |
| Coefficient of Thermal Expansion ($a_1$) | 6.83E-06 | in./in./°F |
| Modulus of Elasticity ($E_1$) | 2.90E+07 | lb/in.$^2$ |
| Yield Strength ($S_{Y1}$) | 103000 | lb/in.$^2$ |
| Poisson Ratio ($v_1$) | 0.29 | |
| Inside Diameter @ Ambient, MMC ($d_1$) | 5.0000 | in. |
| Outside Diameter @ Ambient, LMC ($D_1$) | 6 | in. |
| **Inner Body (Main Charge)** | | |
| Material Specification | Typical of PBX | |
| Coefficient of Thermal Expansion ($a_2$) | 6.20E-05 | in./in./°F |
| Modulus of Elasticity ($E_1$) | 1000 | lb/in.$^2$ |
| Yield Strength ($S_{Y2}$) | 80 | lb/in.$^2$ |
| Poisson Ratio ($v_2$) | 0.5 | |
| Outside Diameter @ Ambient, MMC ($D_2$) | 5.0300 | in. |
| * Assumes solid body with no interior hole. | | |
| **Process Parameters** | | |
| Outer Body Assembly Temperature ($t_1$) | 140 | °F |
| Inner Body Assembly Temperature ($t_2$) | -50 | °F |

CONTINUED ON FIG 7B

*Note: all values are at quasi-static strain rates.

FIG.7A

CONTINUED FROM FIG 7A

| Resultant Parameters | Value | Unit of Measure | Notes |
|---|---|---|---|
| **Conditions at Assembly** | | | |
| $d_1$ | **5.0023** | in. | |
| $D_2$ | **4.9920** | in. | |
| Assembly Clearance, Diametral | **0.0104** | in. | |
| **Conditions at $T_{max.}$** | | | |
| Unconstrained $d_1$ | **5.0030** | in. | |
| Unconstrained $D_2$ | **5.0574** | in. | |
| Interference, Diametral | **0.0544** | in. | |
| Interface Radius | **2.5015** | in. | |
| Pressure at Interface | **22** | lb/in.$^2$ | Based on Lamè Equations |
| Outer Body Tensile Hoop Stress | **121** | lb/in.$^2$ | |
| Inner Body Compressive Stress | **-22** | lb/in.$^2$ | Negative value is compressive |
| **Conditions at $T_{amb.}$** | | | |
| Unconstrained $d_1$ | **5.0000** | in. | |
| Unconstrained $D_2$ | **5.0300** | in. | |
| Interference, Diametral | **0.0300** | in. | |
| Interface Radius | **2.5000** | in. | |
| Pressure at Interface | **12** | lb/in.$^2$ | |
| Outer Body Tensile Hoop Stress | **67** | lb/in.$^2$ | |
| Inner Body Compressive Stress | **-12** | lb/in.$^2$ | |
| **Conditions at $T_{min.}$** | | | |
| Unconstrained $d_1$ | **4.9955** | in. | |
| Unconstrained $D_2$ | **4.9888** | in. | |
| Interference, Diametral | **-0.0067** | in. | Negative value is clearance |
| Interface Radius | **2.4977** | in. | |
| Pressure at Interface | **0** | lb/in.$^2$ | |
| Outer Body Tensile Hoop Stress | **0** | lb/in.$^2$ | |
| Inner Body Compressive Stress | **0** | lb/in.$^2$ | |

* Note all equations assume that there is sufficent ullage space to allow inner body to expand within outer body.

FIG.7B

EXPLOSIVE ORDNANCE COLD ASSEMBLY PROCESS

CROSS REFERENCE TO RELATED APPLICATIONS

This application claims the benefit of priority of U.S. Provisional Patent Application Ser. No. 62/577,533 filed Oct. 26, 2017, the content of which is incorporated by reference herein in its entirety.

BACKGROUND OF THE DISCLOSURE

Projectiles fired from conventional military weapons often carry energetic payloads made up of nested components and subcomponents, one within another. Energetic payloads often include explosives that may be initiated by physical impact with a target. These payloads undergo tremendous dynamic stresses during acceleration within either a smooth or rifled barrel of the weapon. If the nested components are not solidly in contact with each other during this acceleration, spontaneous ignition of the energetic components can become a real possibility. Such stresses also occur during deceleration for projectiles designed to penetrate within a target before detonation. Consequently, precise component tolerances of such payloads and projectiles are required. Even with the best design and assembly controls, some tolerances between components and subcomponents exist such that finite spaces can develop between components during handling and field operational conditions. It is often virtually impossible to prevent formation and inclusion of small internal void spaces and undetectable cracks in the explosive charge body which can lead to system failure in the event of an unanticipated shock load. Furthermore, some energetics loading processes are prone to periodically yield cracks or voids. Traditional thermal cycling and field use also may create cracks consequently requiring surveillance programs on the polymeric components as the polymers age. Therefore there is a need for a projectile payload assembly process that prevents, in advance, development of such spaces within the payload and projectile.

SUMMARY OF THE DISCLOSURE

A process in accordance with the present disclosure involves generally the shrinking of a body that would be entrained in situ within another body by means of cold assembly. The inner body is chilled below the operation temperature of the outer body in practical use. In other words, the inner body is first formed at a low temperature and then encapsulated inside a container or outer constraining body, such that the inner body, upon temperature normalization of the combined inner and outer body to within a design range, is maintained in a compressed state within the outer body throughout the lifecycle temperature range of the resultant product. This cold assembly process ensures that constant compression between the components is always maintained.

One embodiment in accordance with the present disclosure is a process for forming an explosive projectile such as a bomb, mortar shell, penetrating warhead, or other ordnance. This process includes providing an explosive body having an external surface portion adapted to fit within and nest against at least a portion of a hollow projectile body, shaping the explosive body so as to fit within the projectile body with the external surface portion in full contact with the at least a portion of the hollow projectile body at the lowest anticipated projectile operating temperature, cooling the explosive body to a temperature below a lowest anticipated operating temperature of the projectile, nesting the cooled explosive body within the hollow projectile body, and then permitting the body temperatures to normalize. The process may also include raising the temperature of the hollow projectile body to an elevated operating temperature, and while the projectile is at the elevated temperature, securing the cooled explosive body and the hollow projectile body together, and then normalizing the temperature of the nested bodies by allowing them to come to a common temperature, typically room temperature.

When below the lowest anticipated product operating temperature the explosive body will be spaced or separated from the inner diameter of the projectile body preferably by a predetermined gap. This gap facilitates relative movement between the bodies while the bodies are being nested together. This exemplary process may include placing the explosive body within a chamber containing a dry gas such as an inert gas prior to cooling the explosive body and nesting the explosive body within the hollow projectile body. This prevents condensation of moisture from air collecting on the cooled explosive body and deteriorating the explosive body or accelerating corrosion during the life cycle of the ordnance. The desired temperature below the lowest anticipated operating temperature is generally between −70 and −40 degrees Fahrenheit, and may preferably be in a range of between −60 and −50 degrees Fahrenheit. The act of securing may include closing the explosive body within the projectile body with a bulkhead or sealing disc, fuse holder, or other closure device. The process may also include normalizing the temperatures of the secured explosive and projectile bodies at a controlled rate.

A projectile formed by the above exemplary process will result in the projectile body applying a substantially constant compression against the explosive body across the anticipated temperature range of the projectile during its life cycle and avoids unbalancing the projectile by changes of center of gravity or other asymmetries which might result from mismatch of the inner explosive body to the outer projectile body. Where the inner explosive body that has some plasticity, the constant compression provides intimate contact with all interior geometries which may be mismatched slightly due to machining, metal forming, molding or other processes which otherwise might create gross or slight discontinuities.

Compression loading in accordance with the process described herein ensures no gaps, either crack or voids, even small unanticipated voids can form or propogate, through the performance temperature range of the ordnance, which ensures that problems associated with adiabatic compression are eliminated, either during energetics component loading, projectile storage, handling, launch or during target entry. Furthermore, elimination of mass movement inside of a penetration weapon projectile provides for greater fuse survivability during target entry, most especially that which is related to tail slap, where the explosive body itself is no longer allowed to accelerate into the fuse structures. In addition, the new processing approach in accordance with the present disclosure is anticipated to prevent latent effects due to environmental stresses from impacting functionality and eliminate the impact of those realized through or during normal loading processes when the compressive approach described herein is utilized.

An embodiment of the present disclosure may alternatively be viewed as a process for forming an explosive projectile that includes shaping an explosive body to fit and nest within a hollow projectile body, raising the temperature of the hollow projectile body to about a highest anticipated product operating temperature, cooling the explosive body to a temperature below a lowest anticipated operating temperature of the projectile, nesting the cooled explosive body within the hollow projectile body, securing the explosive body and the hollow projectile body together; and normalizing the temperature of the nested bodies to a common temperature. This process may include placing the explosive body within a chamber containing a dry atmosphere such as an inert gas prior to cooling the explosive body and nesting the explosive body within the hollow projectile body. The temperature below the lowest anticipated operating temperature may be between −70 and −40 degrees Fahrenheit and may more preferably be between −60 and −45 degrees Fahrenheit. The process of securing may include closing the explosive body within the projectile body with a bulkhead. When the explosive body is below the lowest anticipated product operating temperature the explosive body and projectile bodies are preferably separated by a predetermined gap while the bodies are being nested together. Thus when temperatures are normalized this gap disappears and the energetic body is compressed within the projectile body thus maintaining an interference fit between the explosive body and the hollow projectile body.

These and other features, advantages and attributes of a projectile assembled in accordance with the present disclosure will be better understood when consideration is given to the following detailed description in conjunction with the drawing figures.

DESCRIPTION OF THE DRAWINGS

FIG. 7A and FIG. 7B taken together is a table showing input and resultant stress model calculation parameters for an exemplary projectile as is shown in FIG. 1.

DETAILED DESCRIPTION

Figure 1:
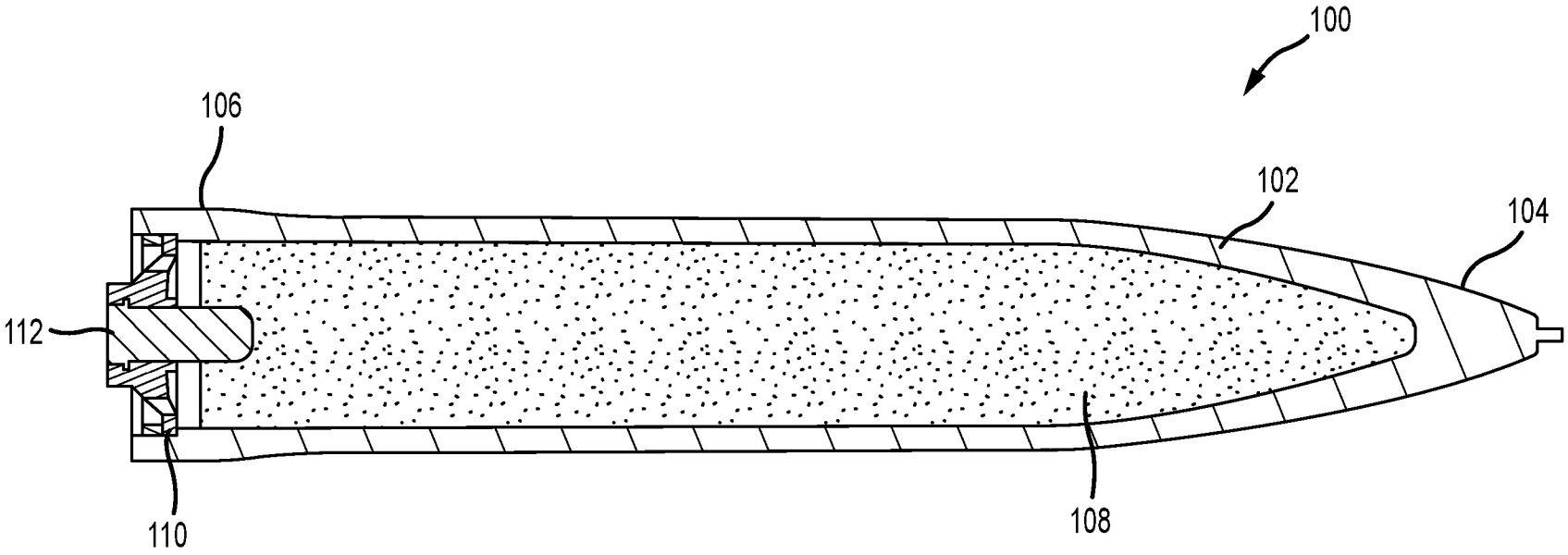
FIG. 1 is a schematic sectional view of an assembled projectile or bomb in accordance with one exemplary embodiment of the present disclosure.

A first exemplary embodiment of a projectile 100 assembled in accordance with one embodiment of the process of the present disclosure is shown schematically in a longitudinal sectional view in FIG. 1. The projectile 100 has a hollow, generally tubular frangible projectile body 102 having a pointed closed nose 104 and an open rear 106. The projectile body 102 is typically made of a steel or other strong metal material and has a characteristic coefficient of thermal expansion (CTE) for that material.

The projectile body 102 contains an explosive charge body 108 such as a RDX, CDX or other explosive which may be in the form of a solid body or other form that is encapsulated in an solid enclosure such as a polyethylene liner so as to have a shape complementary to the internal shape or contour of the projectile body 102. The explosive charge body or package 108 as a whole also has a characteristic CTE because it will tend to expand or contract its outer dimensions with changes in temperature.

A fundamental feature of the process in accordance with the present disclosure is selection of the external shape and size of the explosive charge and the projectile body inside dimensions such that when assembled, the projectile body 102 maintains a compressive force against the explosive charge body 108 during all anticipated operational conditions that the projectile 100 may encounter during its lifetime. For example, a 120 mm projectile body 102 may have a nominal inside diameter at a room temperature of 70° F. of 104 mm. A clearance of about 0.05 mm between the explosive charge body 108 and the 104 mm ID may facilitate smooth insertion of the explosive charge body 108 into the projectile body 102. If the explosive charge body 108 has an OD of 104 mm and the projectile 102 has an ID of 103 mm, clearly the explosive charge body 108 will not fit within the projectile body 102. However, if the projectile body 102 is heated to about 160F this ID of 103 mm will expand due to its CTE, for example, to about 106 mm. Similarly, if the explosive charge body 108 is cooled to −50 F its OD will shrink according to its CTE to perhaps 102 mm. There will be a net clearance of 4 mm between the cold explosive body 108 and the hot projectile body 102 in this example. If the chilled explosive body 108 is then inserted within the heated projectile body 102 and body temperatures allowed to normalize to room temperature, the projectile body 102 ID will return to about 103 mm and a compressive force will remain against the explosive body 108 that wants to expand to 104 mm. It is this residual compressive force in accordance with the present disclosure that ensures that no voids and cracks can form between the explosive charge body 108 and the projectile body 102 throughout the lifetime of the projectile 100.

At the rear end 106 of the example projectile body 102 is an annular closure disc 110 that carries a suitable fuse 112. The closure disc 110 and fuse 112 may abut against and essentially enclose the explosive charge body 108 within the projectile body 102. In other embodiments, not shown, the closure disc 110 simply retains the nested portions of the explosive charge and projectile body 102 together in a fixed position.

Figure 5:
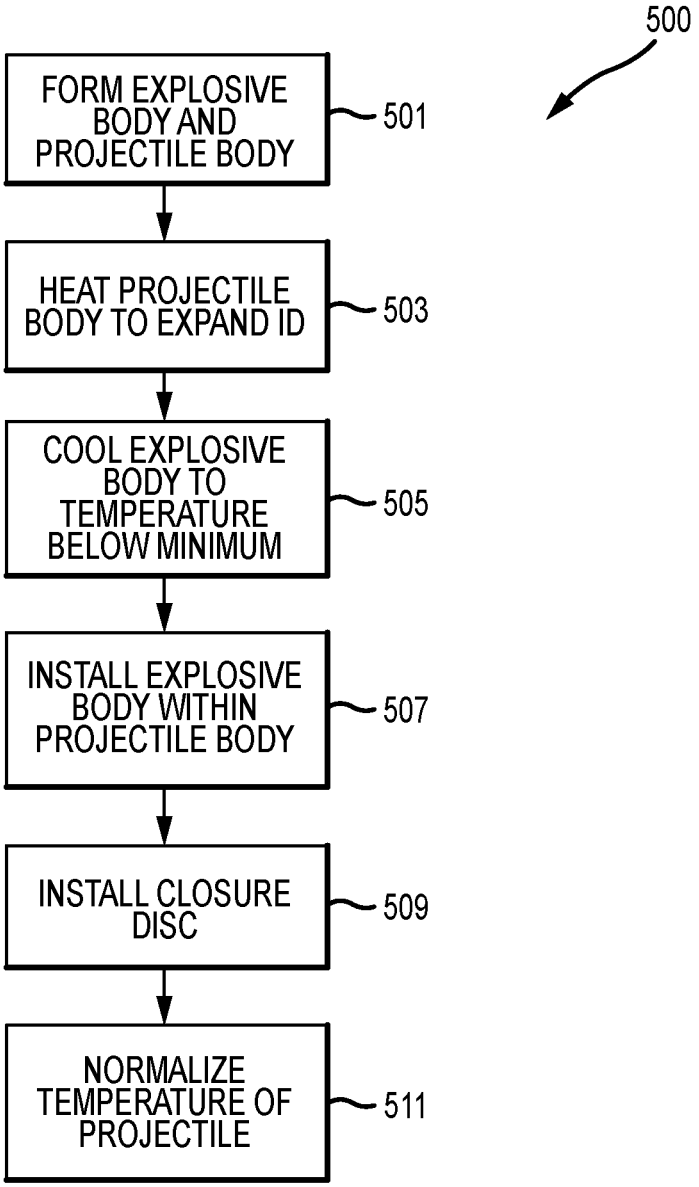
FIG. 5 is a block diagram of the process in accordance with one exemplary embodiment of the present disclosure.

The assembly process 500 in accordance with embodiments of the present disclosure is shown in the flow diagram of FIG. 5. This exemplary process begins in operation 501 where the explosive body 108 is formed with an outer diameter (OD) and a projectile body 102 is formed with an inner diameter equal to or less that the OD of the explosive body at normal room temperature. The projectile body 102 is then optionally heated in operation 503 to a temperature approximately at or above anticipated maximum temperature for the projectile 100 during its operational lifetime. This heating operation may be unnecessary if the CTE for the explosive body 108 is sufficiently large enough to provide sufficient clearance during insertion within the projectile body 102.

The explosive body 108 is separately cooled in operation 505 to a temperature below the expected minimum temperature for the projectile 100 during its operational lifetime. Operations 503 and 505 may be performed in sequence, separately, or at the same time. Then, in operation 507, while the explosive charge body 108 is cold and the projectile body preferably heated, the explosive charge body 108 is inserted into and/or nested within the projectile body 102. After insertion of the explosive charge body 108 in to the projectile body 102, the closure disc 110 is installed in operation 509, which maintains the fuse 112 is direct contact with the explosive charge body 108. Then temperatures of the explosive charge body 108 and projectile body 102 are normalized back to room temperature. Because of the different thermal expansion characteristics of the explosive charge body and the projectile body, and the initial choice of ID and OD of these bodies, there will be a residual compressive force exerted between the projectile body 102 and the explosive charge body 108 such that an interference fit between them is maintained throughout the life cycle of the projectile 100.

Figure 2:
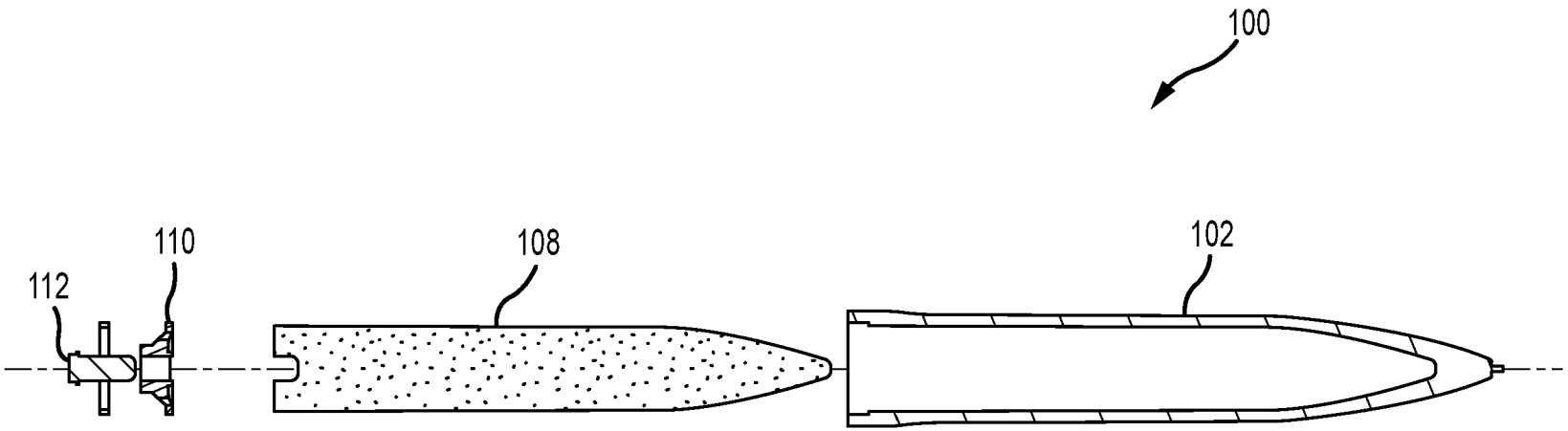
FIG. 2 is an exploded view of the projectile shown in FIG. 1 illustrating the assembly process in accordance with the present disclosure.
Figure 6:
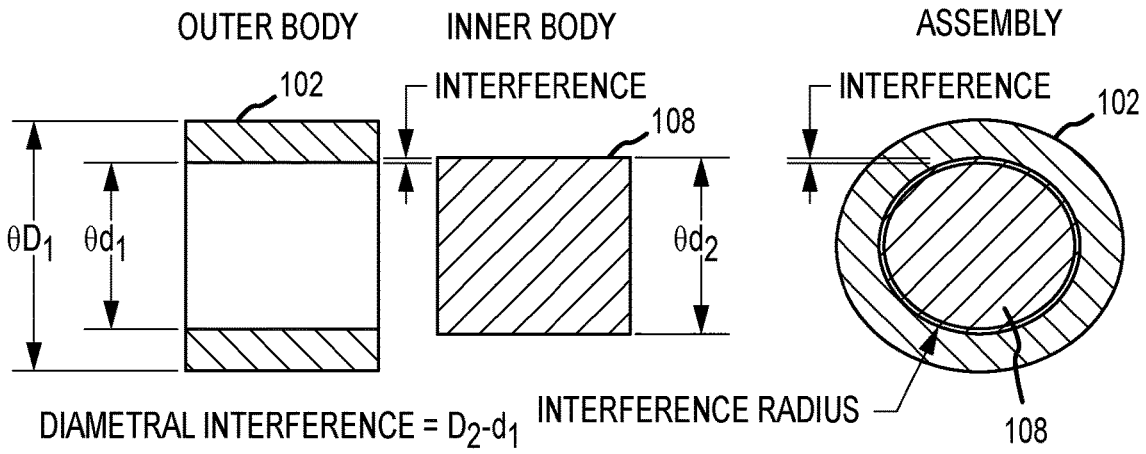
FIG. 6 is a schematic cross sectional diagram for analysis of the exemplary shrink fit projectile shown in FIG. 1.

FIG. 6 illustrates a cross sectional view of the exemplary projectile 100 shown in FIGS. 1 and 2 identifying one dimensional calculation parameters utilized in a thermal shrink fit calculation model. FIGS. 7A and 7B illustrate exemplary input parameters and resultant stress parameters for the one dimensional stress model utilized.

In particular, the exemplary calculation model assumes an inside diameter of outer body 102 of about 5.0000 inches at an ambient temperature, typically 70° F. The outer body outside diameter is 6 inches. The main charge body 108 outer diameter at ambient temperature is 5.0300 inches. During assembly, as described herein, the outer body 102 temperature is raised to 140° F. The inner body 108 temperature is lowered to −50° F. At this lowered temperature, the inner body 108 has an outer diameter $D_2$ of 4.9920 inches. The outer projectile body 102 has an inner diameter d1 of 5.0023 inches, which permits insertion of the inner explosive charge body 108 into the projectile body 102 with a clearance of about 0.0103 inches. When the assembled projectile returns to ambient temperature, a residual compressive stress of −12 lb/in$^2$ remains between the charge body 108 and the outer projectile body 102.

The calculation model results shown in FIGS. 7A and 7B indicate that at the maximum assembly temperature Tmax the compressive force between the charge body 108 and projectile body 102 is about −22 lb/in2. At the exemplary calculated Tmin of −60° F., there would be a zero hoop stress at the interface between the projectile body 102 and charge 108 yielding a clearance of about 0.0067 inches. However, proper choice of initial clearances can be specified to ensure that throughout the anticipated lifetime operational temperature range of the assembled projectile 100 a negative compressive stress can be maintained at the interface between the charge body 108 and projectile body 102 in accordance with the present disclosure.

Figure 3:
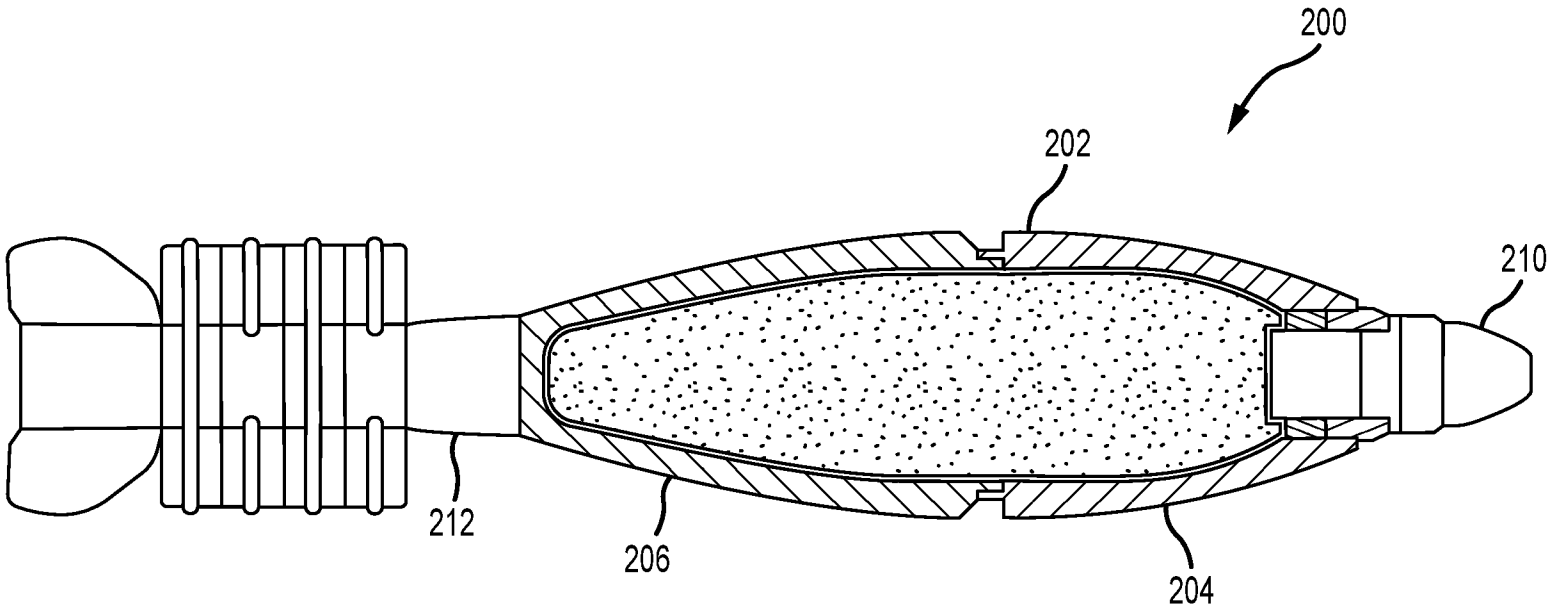
FIG. 3 is a schematic sectional view of an assembled mortar projectile in accordance with another exemplary embodiment of the present disclosure.
Figure 4:
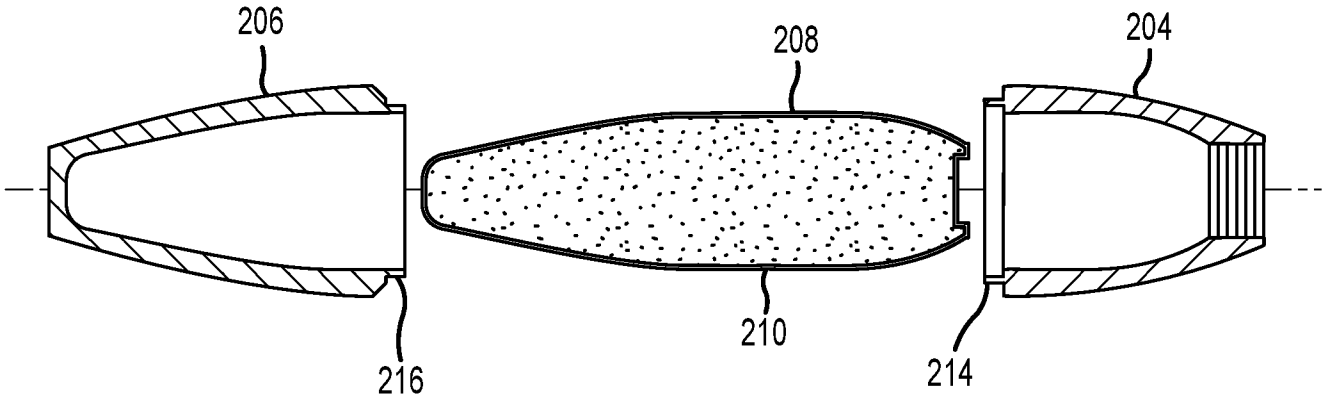
FIG. 4 is an exploded view of a payload portion of the mortar projectile shown in FIG. 3.

Another embodiment of a projectile formed in accordance with an exemplary embodiment of the present disclosure is shown in FIGS. 3 and 4. In this case, the projectile is a mortar shell 200. The mortar shell 200 incudes a two piece projectile body 202 made up of front casing 204 and rear casing 206 which close together to enclose an explosive charge body 208. Attached to the front casing 204 is a fuse module 210. Attached to the rear casing 206 is a propulsion module 212 that provides the lift and guidance/direction for the mortar shell 200 upon discharge from a mortar tube (not shown).

The assembly process for assembly of the mortar shell 200 is illustrated by the exploded view of FIG. 4. The separable front and rear mortar shell casings 204 and 206 are first fabricated from frangible metal having a particular CTE and inner ID shape. The explosive charge body 208 is separately formed and may be encapsulated in a liner 210 or other enclosing body and has a particular CTE and outer OD shape slightly greater than the ID shape of the projectile body 202. A liner 210, if utilized, protects the explosive charge body 208 from adverse effects of contact with the mortar shell casings 204 and 206. Some explosives may be corrosive to the casing material, for example, and thus an encapsulating liner 210 is preferably utilized in those situations.

The shell casings 204 and 206 are sized such that their ID size is slightly less than the OD size of the explosive charge body 208, similar to that described above with reference to the projectile 100, so that when the explosive charge body 208 is chilled and the shell casings 204 and 206 heated, there will be a small gap between them such that the shell casings 204 and 206 may be fastened together to enclose the explosive body 208 and create and then maintain a compressive force against the charge body 208 when temperature of the mortar shell 200 is subsequently normalized.

In assembly of this exemplary embodiment shown in FIGS. 3 and 4, the mortar shell casings 204 and 206 may preferably be heated to a temperature near the maximum anticipated operational temperature for the mortar shell 200 during its useful lifetime. The encapsulated explosive charge body 208 is cooled to a temperature below the minimum anticipated operational temperature for the mortar shell 200 during its useful lifetime. This range of temperatures may run from about −40 F to +160 F, for example. Hence one exemplary cold range for the explosive charge body would be between −70 F and −40 F. A more preferable cold range may be between −60 F to about −50 F. Once the explosive charge body 208 is cooled sufficiently, it is placed within the preferably heated shell casings 204 and 206 and the casings joined. The shell casings may be fastened together via threaded connections, snap closures or wired connections, for example. In the embodiment shown in FIG. 4, for example, the front casing 204 has male threads 214 and the rear casing 206 has female threads for joining the casings together. The assembled casings enclosing the explosive charge body 208 are then allowed to return to normal temperature before final assembly. Once normal temperature is achieved, the fuse module 210 is fastened to the front casing 204 and the propulsion module 212 fastened to the rear casing 206. The threaded connections between the casings 204 and 206 may permit the explosive charge body 208 to be readily removed at the end of useful mortar shell life. Again, this process 500 is described above and shown in FIG. 5.

Again, whether or not the projectile casings 204 and 206 need to be heated prior to assembly depends on the CTE of the casings and the explosive charge body 208. If the CTE is low enough for the casings 204 and 206, the CTE for the explosive charge body 208 high enough, and the explosive charge body or casing dimensions carefully chosen, such that cooling the explosive charge body 208 provides sufficient clearance gap for loading, heating of the casings may not be necessary in order to form an assembled projectile 200, when thermally normalized, that maintains a constant compressive force against the explosive charge body throughout the anticipated lifetime of the projectile 200.

Many variations may be made to the above described process and will be evident to an ordinary person skilled in the art upon reading the above disclosure. All such changes, alternatives and equivalents in accordance with the features and benefits described herein, are within the scope of the present disclosure. Such changes and alternatives may be introduced without departing from the spirit and broad scope of this disclosure as defined by the claims below and their equivalents.

What is claimed is:

1. A process for forming an explosive projectile, the process comprising:

providing an explosive charge body having an external surface portion adapted to fit within and nest against at least a portion of a hollow projectile body;

shaping the explosive charge body so as to fit within the projectile body with the external surface portion in full contact with the at least a portion of the hollow projectile body at a lowest anticipated projectile operating temperature;

cooling the explosive charge body to a temperature below the lowest anticipated operating temperature of the projectile;

nesting the explosive charge body within the hollow projectile body;

securing the explosive charge body and the hollow projectile body together; and normalizing the temperature of the nested bodies to a common temperature.

2. The process according to claim 1 further comprising raising the temperature of the hollow projectile body to a highest anticipated product operating temperature prior to nesting.

3. The process according to claim 2 further comprising placing the explosive charge body within a chamber containing an inert gas prior to cooling the explosive body and nesting the explosive body within the hollow projectile body.

4. The process according to claim 1 wherein the temperature below the lowest anticipated operating temperature is between −70 and −40 degrees Fahrenheit.

5. The process according to claim 4 wherein the temperature below the lowest anticipated operating temperature is between −60 and −45 degrees Fahrenheit.

6. The process according to claim 1 wherein securing includes closing the explosive charge body within the projectile body with a bulkhead.

7. The process according to claim 1 further comprising normalizing temperature of the nested bodies at a controlled rate.

8. The process according to claim 1 wherein when below the lowest anticipated operating temperature of the projectile the the explosive charge body and the hollow projectile body are separated by a predetermined gap while the bodies are nested.

9. A process for forming an explosive projectile, the process comprising:

shaping an explosive charge body to fit and nest within a hollow projectile body;

cooling the explosive charge body to a temperature below a lowest anticipated operating temperature of the projectile;

nesting the explosive charge body within the hollow projectile body;

securing the explosive charge body and the hollow projectile body together; and normalizing the temperature of the nested bodies to a common temperature.

10. The process according to claim 9 further comprising placing the explosive charge body within a chamber containing an inert gas prior to cooling the explosive charge body and nesting the explosive charge body within the hollow projectile body.

11. The process according to claim 9 wherein the temperature below the lowest anticipated operating temperature is between −70 and −40 degrees Fahrenheit.

12. The process according to claim 11 wherein the temperature below the lowest anticipated operating temperature is between −60 and −45 degrees Fahrenheit.

13. The process according to claim 9 wherein securing includes closing the explosive charge body within the projectile body with a bulkhead.

14. The process according to claim 9 wherein when below the lowest anticipated operating temperature of the projectile the explosive charge body and the hollow projectile body are separated by a predetermined gap while the bodies are being nested and wherein when temperature is normalized the energetic charge body is compressed within the projectile body.

15. The process according to claim 9 further comprising raising the temperature of the hollow projectile body to a highest anticipated product operating temperature prior to nesting the cooled explosive charge body within the projectile body.

16. The process according to claim 15 further comprising placing the explosive charge body within a chamber containing an inert gas prior to cooling the explosive charge body and nesting the explosive charge body within the hollow projectile body.

17. The process according to claim 15 wherein the temperature below the lowest anticipated operating temperature is between −70 and −40 degrees Fahrenheit.

18. The process according to claim 17 wherein the temperature below the lowest anticipated operating temperature is between −60 and −45 degrees Fahrenheit.

19. The process according to claim 15 wherein securing includes closing the explosive charge body within the projectile body with a bulkhead.

20. The process according to claim 15 wherein when below the lowest anticipated operating temperature of the projectile the explosive charged body and the hollow projectile body are separated by a predetermined gap while the bodies are being nested and wherein when temperature is normalized the energetic body is compressed within the projectile body.

* * * * *